United States Patent [19]

Stevens

[11] Patent Number: 4,660,472

[45] Date of Patent: Apr. 28, 1987

[54] OPTICAL THROUGH BULKHEAD INITIATOR AND SAFE-ARM DEVICE

[75] Inventor: George L. Stevens, North Ogden, Utah

[73] Assignee: Morton Thiokol Inc., Chicago, Ill.

[21] Appl. No.: 785,187

[22] Filed: Oct. 7, 1985

[51] Int. Cl.[4] ..... F42B 3/18; C06C 5/04

[52] U.S. Cl. ..... 102/202.1; 102/275.3; 102/275.6; 102/275.12; 102/275.4; 102/275.7; 102/275.5; 102/275.11; 89/1.14

[58] Field of Search ..... 102/200, 202.1, 205, 102/275.3, 275.4, 275.5, 275.6, 275.7, 275.11, 275.12; 89/1.14

[56] References Cited

U.S. PATENT DOCUMENTS

| | | | |
|---|---|---|---|
| 3,371,607 | 3/1968 | Olsson | 102/275.5 X |
| 4,265,177 | 5/1981 | Lundborg et al. | 102/275.5 X |
| 4,319,526 | 3/1982 | DerMott | 102/202.1 X |
| 4,423,682 | 1/1984 | Schimmel | 89/1.14 X |
| 4,424,747 | 1/1984 | Yunan | 102/275.7 X |
| 4,608,926 | 9/1986 | Stevens | 102/275.4 |

FOREIGN PATENT DOCUMENTS

| | | | |
|---|---|---|---|
| 1059832 | 8/1979 | Canada | 102/200 |
| 30498 | 6/1981 | European Pat. Off. | 102/275.4 |

*Primary Examiner*—Peter A. Nelson

*Attorney, Agent, or Firm*—Gerald K. White

[57] ABSTRACT

A pyrotechnic system for transmitting an initiation stimulus through a bulkhead in which a pressure seal is to be maintained includes an ordnance transfer line for initiating illuminating charge of pyrotechnic material such as certain metal-oxidizer mixes which have a high reaction temperature and high emissivity. The radiation energy produced is transmitted through a sealed window which serves as a focussing lens to irradiate a booster charge. The booster charge, in turn, may be made to initiate a transfer line, serve as an igniter or pressure cartridge. Only deflagrating materials are used in the system.

A safe and arm mechanism is obtained by incorporating a mechanical shutter which blocks the radiation from the illuminating charge to the booster charge when in the "SAFE" position and allows the radiation to be transmitted when in the ARM position.

20 Claims, 3 Drawing Figures

OPTICAL THROUGH BULKHEAD INITIATOR AND SAFE-ARM DEVICE

BACKGROUND OF THE INVENTION

1. Field of the Invention

This invention relates to pyrotechnic systems and, more particularly, to such systems in which an ignition stimulus is transmitted to a pyrotechnic device that is maintaining a pressure seal. Such systems have utility in initiators, igniters and rocket motors.

2. Description of the Prior Art

The technique of using a shock wave, generated by a detonation reaction to provide an initiation stimulus that is propagated through a hermetically sealed metal bulkhead has long been known in the prior art. Devices utilizing this technique are called through bulkhead initiators.

Such initiators accept an explosive signal or shock wave from a detonation type transfer mechanism at the upstream side of the bulkhead and convert it to a hot gas output on the downstream side of a solid barrier or bulkhead. This barrier provides a pressure seal during operation of the ordnance item. The barrier or bulkhead must have the structural integrity to withstand both the detonation sequence and the operational pressure of the ordnance device, and desirably, therefore, is made of a material such as stainless steel.

The initiation stimulus is transmitted through the sealed metal bulkhead through shock waves. The shock wave generated at the upstream side of the bulkhead by a donor charge is transferred to the metal bulkhead and is propagated therethrough to an acceptor charge. Sufficient energy is contained in the shock wave received by the acceptor charge to cause a detonation reaction. This reaction is transmitted to an output charge where it is transformed into a deflagration reaction.

Detonating type transfer mechanisms consist essentially of a train of explosive charges encased within a wrapping that forms a fuze duct. A detonation is initiated at one end of the train of explosive of the fuze duct and propagated at a high velocity, typically 24,000 feet per second (7,315 meters per second), through the train of explosive to each of the charges. In order to ensure the propagation of the detonation of the train of explosive charges, the fuze duct must contain a great quantity of explosive per unit length. This, in itself, introduces a hazard that objects positioned nearby the fuze may be damaged upon initiation of the detonation. Additionally, such a fuze must be carried and shipped as an explosive under observation of special precautionary measures prescribed for such dangerous goods.

Deflagration type transfer mechanisms have been used instead of detonation type transfer mechanisms to avoid the foregoing problems. When a deflagration type transfer mechanism is used, however, the shock wave type through bulkhead initiator must be modified to provide a "deflagration to detonation" transition on the upstream side of the bulkhead and a "detonation to deflagration" transition on the downstream side in order to be compatible with the deflagration type system. Such modification adds undesirably to the complexity and, hence, difficulty and cost of manufacturing through bulkhead initiators while still requiring the use of detonating materials and the attendant disadvantages thereof.

Thus, there is a need and a demand in the art for improvements in systems for transmitting an initiation stimulus to a pyrotechnic device which is maintaining a pressure seal. The present invention was devised to fill the technological gap that exists for systems of this type.

SUMMARY OF THE INVENTION

An object of the invention is to provide, for initiating various explosive functions, a pyrotechnic system characterized in its utilization of an optical principle in which the initiation stimulus is transferred through a sealed quartz, or equivalent, bulkhead using radiant energy.

Another object of the invention is to provide such a system in which only deflagrating materials are used in the system.

A further object of the invention is to incorporate in such a system a safe and arm mechanism which will preclude initiation of the explosive function when in the "SAFE" condition and allow such initiation in the "ARM" condition.

Still another object of the invention is to provide a through bulkhead initiator in which a small illuminating charge is used to ignite an ignition charge for larger devices.

In accomplishing these and other objectives of the present invention, there is provided a deflagration type of ordnance transfer line to initiate an illuminating charge of pyrotechnic material having a high reaction temperature and a high emissivity. The resulting radiant energy produced at various wavelengths in the infrared range of the electromagnetic spectrum is transmitted through a window which is transparent to wavelengths in that range and which serves also as a focussing lens to irradiate a booster target charge of a deflagrating type of pyrotechnic with high intensity radiation. The booster target charge, in turn, may initiate a deflagrating type transfer line, serve as an igniter or a pressure cartridge.

A feature of the invention is that it can be the basis for a safe and arm mechanism by incorporating a mechanical shutter to block the path of the radiant energy when in the "SAFE" position and to open that path when in the "ARM" position.

The various features of novelty which characterize the present invention are pointed out with particularity in the claims annexed to and forming a part of this specification. For a better understanding of the invention, its operating advantages, and specific objects attained by its use, reference is made to the accompanying drawings and descriptive matter in which preferred embodiments of the invention are illustrated.

BRIEF DESCRIPTION OF THE DRAWINGS

Having summarized the invention, a detailed description follows with reference being had to the accompanying drawings which form part of the specification, of which.

DESCRIPTION OF THE PREFERRED EMBODIMENTS

Figure 1:
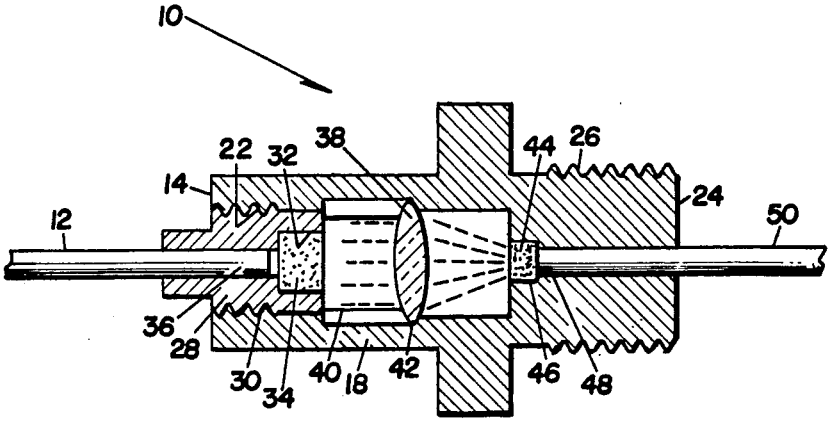
FIG. 1 is a view of the pyrotechnic system of the present invention used for initiating a deflagrating transfer line and showing the optical through bulkhead initiator thereof in cross section.

In FIG. 1 of the drawings, there is illustrated a pyrotechnic system 10, according to the invention, for transferring an initiation signal through a hermetically sealed bulkhead. System 10 includes an ordnance transfer line 12 that is suitably attached to the input side 14 of a through bulkhead initiator 16. The input side 14 of the initiator 16 is adapted to be positioned on the upstream side of the bulkhead (not shown) in which a pressure seal is to be maintained. Initiator 16 includes a metal body 18 having an elongated cylindrical opening bore or cavity 20 therein. Adjacent the input side 14 of initiator 16, cavity 20 is provided with an internal screw thread 22. The other or output side 24 of initiator 16 is adapted to be positioned on the downstream side of the bulkhead and is provided with an external screw thread 26. Screw thread 26 is provided to facilitate attachment of the initiator 16 to an ordnance device (not shown) through the bulkhead of which an initiation stimulus is to be transferred and in which a pressure seal is to be maintained. The output side 24 of initiator 16 is optically in communication with the input side 14 through the cavity 20.

Transfer line 12 is attached to the input side 14 of initiator 16 by means of a fitting 28 having an screw thread 30 that is adapted to engage the internal screw thread 22 in opening 20. At the inner end of fitting 28, there is provided a recess 32 in which an illuminating charge 34 is contained. Charge 34 is disposed in operative relation with the inner end 36 of transfer line 12. While not shown, thin plastic may be employed to hold charge 34 in place in recess 32.

Also contained within the opening 20 in initiator 16 is a radiation energy transmitting window or lens 38. Lens 38 provides a seal in cavity 20 between the input side 14 of initiator 16 and the output side 24 thereof and may be made of a material such as quartz, sapphire, magnesium fluoride, etc. for efficient transmission of radiant energy and is retained fixed in position by a tubular member 40 between the inner end of fitting 28 and an annular shoulder 42 that is provided at an intermediate location in cavity 20.

Adjacent the inner end of cavity 20 is a booster target charge 44. Charge 44 is retained in a recess 46 in operative relation with the end 48 of an ordnance transfer line 50. Transfer line 50 extends into the output side of initiator 16 with the end 48 being suitably connected thereto as by a suitable adhesive.

Each of transfer lines 12 and 50 preferably comprise a deflagrating type of ordnance transfer line or ignition strand such as "TLX," "Hivelite," etc. "TLX" is a type of ignition strand that is manufactured and sold commercially by Explosive Technology, a subsidiary of OEA, Inc., Fairfield, Calif. While not critical to the operation of the pyrotechnic system 10, each of the transmission lines 12 and 50 may be of the type sold commercially by Explosive Technology under the code designation "PP-23-T" and having an external diameter of 3.05 mm. and an internal diameter of 0.055 mm.

"Hivelite" is a type of ignition strand or fuze that is manufactured and sold commercially by Teledyne McCormick-Selth, 3601 Union Rd., P.O. Box 6, Hollister, Calif., and comprises a rapidly burning material that is encased in a lead sheath having a polyethylene jacket.

Illuminating charge 34 may comprise a pyrotechnic material such as certain metal-oxidizer mixes having a high reaction temperature and a high emissivity, for example, magnesium-teflon (a trademark of E. I. du Pont de Nemours and Company) in a 50—50 ratio, or boron-potassium nitrate granules in a 74–26 ratio, the percentage of oxidizer being the greater.

According to the Stefan-Boltzmann law, the radiation flux density produced by charge 34 upon initiation thereof will be equal to the product of the Stefan-Boltzmann constant multiplied by the emissivity of the charge 34 multiplied by the absolute temperature thereof to the fourth power.

Booster target charge 44 is a deflagrating type of pyrotechnic with high intensity radiation. A pyrotechnic material suitable for use therefor is boron-potassium nitrate granules in a 74–26 ratio as above mentioned in connection with charge 34. It is noted that when made of a material such as boron-potassium nitrate, the booster charge 44 is insensitive to inadvertant radiation to which it may be exposed.

In the operation of the pyrotechnic system 10, a stimulus transferred to the illuminating charge 34 by the input transfer line 12 causes the charge 34 to produce intense radiation at various wavelengths in the infrared region of the electromagnetic spectrum. Such radiation is transmitted through the sealed window 38 which also serves as a focussing lens to irradiate the booster target charge 44. Such initiation of the target charge 44 causes it, in turn, to initiate the output transfer line 50.

Figure 2:
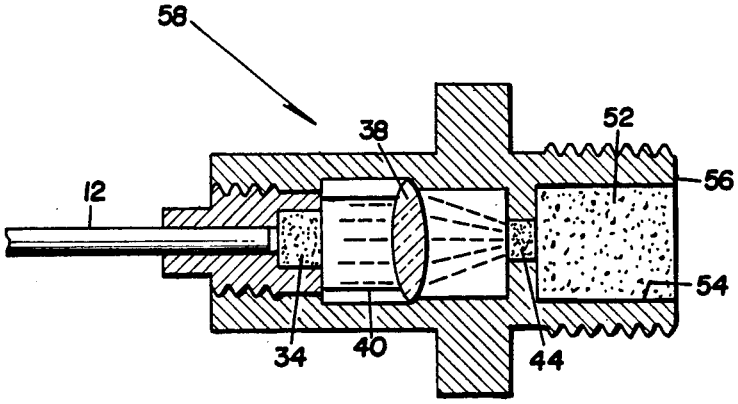
FIG. 2 is a view similar to FIG. 1 showing the pyrotechnic system of the invention used as an igniter or pressure cartridge.

In the modification of the invention illustrated in FIG. 2, the output transfer line 50 has been eliminated and an ignition charge 52 has been provided instead. Ignition charge 52 is contained within a recess 54 provided at the output side 56 of an initiator 58. Initiator 58 may be identical to the initiator 16 of FIG. 1 except for the modification thereof required for the substitution of the ignition charge 52 for the output transfer line 50. The composition of the output charge 52 may comprise boron-potassium nitrate granules in a 74–26 ratio as above described or may be selected as required for the igniter function desired to be performed as known to those skilled in the art.

Figure 3:
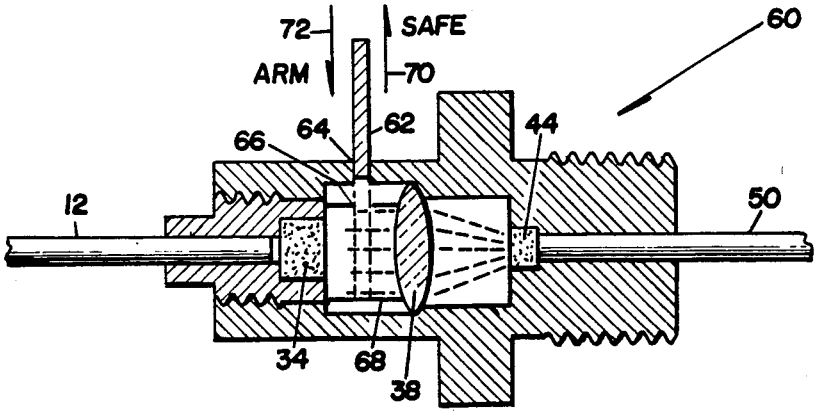
FIG. 3 illustrates a modification of the pyrotechnic system of FIG. 1 comprising a "SAFE"-"ARM" optical through bulkhead initiator.

As illustrated in FIG. 3, another aspect of the invention is that it can be the basis for a safe and arm mechanism by incorporating a mechanical shutter which is operative to block the radiation flux produced by the illuminating charge 34 when in the "SAFE" position and to allow the radiation flux to be transmitted to the lens 38 and booster target 44 when in the "ARM" position. Thus, the initiator 60 of FIG. 3 may be identical to the initiator 16 of FIG. 1 except for the provision of a mechanical shutter 62 that is opaque to or impervious to the radiation produced upon initiation of the illuminating charge 34. Shutter 62 is frictionally held but is manually movable in a slot 64 in the wall of initiator 60 and an adjacent slot 66 in a tubular member 68 that retains the lens 38 fixed in position within initiator 60. When in the lower position indicated by dotted lines in FIG. 3, the shutter 62 is operative to block the radiation flux produced by the charge 34. This position of shutter 62, as indicated by the arrow 70, is the "SAFE" position. In the upper or "ARM" position thereof, as indicated by the arrow 72, the shutter 62 allows radiation from charge 34 to be transmitted through lens 38 to the booster target charge 44.

Thus, in accordance with the invention, there is provided a system for transmitting an initiation stimulus to a pyrotechnic device which is maintaining a pressure seal, in which system deflagrating materials only are used. Also, in accordance with the invention, there may be incorported in the system a safe and arm mechanism which precludes initiation of the explosive function when in the "SAFE" condition and which allows such initiation when in the "ARM" condition. There is also provided, in accordance with the invention, an initiator in which a small illuminating charge is used to ignite an ignition charge for igniting larger devices.

What is claimed is:

1. A pyrotechnic system for transferring an initiation stimulus through a bulkhead comprising, in combination:

an initiator body having an input side adapted to be positioned on the upstream side of the bulkhead, an output side adapted to be positioned on the downstream side of the bulkhead, and having a cavity formed therein in optical communication with said input and output sides, an input ordnance transfer line having ends with one end thereof connected to the input side of said initiator body, output ordnance means associated with the output side of said initiator body, an illuminating charge positioned in said cavity in operative relation to said one end of said input ordnance transfer line, a booster target charge positioned in said cavity in operative relation with said output ordnance means, and radiation energy transmitting means positioned in said cavity intermediate said illuminating charge and said booster charge, said input ordnance transfer line, said illuminating charge, said booster target charge, and said output ordnance means all being of the deflagrating type.

2. A pyrotechnic system as defined by claim 1 wherein said illuminating charge when initiated produces radiation in the infrared region of the electromagnetic spectrum and said radiation energy transmitting means comprises a window that is operative to transmit such radiation and to focus it on said booster target charge.

3. A pyrotechnic system as defined by claim 2 wherein said window comprises a lens made of quartz.

4. A pyrotechnic system as defined by claim 2 wherein said window comprises a lens made of sapphire.

5. A pyrotechnic system as defined by claim 2 wherein said window comprises a lens made of magnesium flouride.

6. A pyrotechnic system as defined by claim 2 further including a mechanical shutter means to provide a SAFE-ARM capability, said mechanical, shutter means being opaque to the radiation produced by said illuminating charge and being movable from a "SAFE" position between said illuminating charge and said window wherein it is operable to block the radiation to said window from said illuminating charge to an "ARM" position out of the path of the radiation from said illuminating charge to said window.

7. A pyrotechnic system as specified in claim 1 wherein said output ordnance means comprises an output transfer line having ends with one end connected to the output side of said initiator and disposed in operative relation with said booster target charge.

8. A pyrotechnic system as specified in claim 1 wherein said initiator includes a recess associated with the output side thereof, and said output ordnance means comprises an ignition charge disposed in said recess.

9. A pyrotechnic system as defined by claim 1 wherein said illuminating charge comprises a composition consisting of magnesium-teflon in a 50—50 ratio of metal to oxidizer and said booster target charge comprises a composition consisting of boron-potassium nitrate in a 74–26 ratio with the oxidizer being the greater.

10. A pyrotechnic system as defined by claim 1 wherein said illuminating charge and said booster target charge each comprise a composition consisting of boron-potassium nitrate in a 74–26 ratio with the oxidizer being the greater.

11. A pyrotechnic system for transferring an initiation stimulus through a bulkhead comprising, in combination:

an initiator body having an input side adapted to be positioned on the upstream side of the bulkhead, an output side adapted to be positioned on the downstream side of the bulkhead, and having a cavity formed therein in optical communication with said input and output sides, an input ordnance transfer line having ends with one end connected to the input side of said initiator body, output ordnance means associated with the output side of said initiator body, fitting means for connecting said one end of said input transfer line to the input side of said initiator, said fitting means having a recess in communicating relation to said cavity in said initiator, an illuminating charge positioned in said recess of said fitting means in operative relation with said one end of said input transfer line, a booster target charge positioned in said cavity of said initiator in operative relation with said output ordnance means, and radiation energy transmitting means positioned in said cavity intermediate said illuminating charge and said booster charge, said input ordnance transfer line, said illuminating charge, said booster target charge, and said output ordnance means all being of the deflagrating type, wherein said illuminating charge when initiated produces radiation in the infrared region of the electromagnetic spectrum, wherein said radiation energy transmitting means comprises a window that seals the output side of said initiator from the input side and is operative to transmit radiation produced by said illuminating charge and to focus it on said booster charge, 12. A pyrotechnic system as defined by claim 11 wherein said window comprises a lens made of quartz.

13. A pyrotechnic system as defined by claim 11 wherein said window is made of sapphire.

14. A pyrotechnic system as defined by claim 11 wherein said window is made of magnesium fluoride.

15. A pyrotechnic system as defined by claim 11 wherein said ordnance means comprises an output transfer line having ends with one end connected to the output side of said initiator and disposed in operative relation with said booster target charge.

16. A pyrotechnic system as defined by claim 11 wherein said initiator includes a recess associated with the output side thereof and said output ordnance means comprises an ignition charge disposed in said recess.

17. An optical through bulkhead initiator comprising, an initiator body having an input side adapted to be positioned on the upstream side of the bulkhead, an output side adapted to be positioned on the downstream side of the bulkhead, and having a cavity formed therein providing optical communication with both of said input and output sides, said input side being adapted for connection to and in operative association with an input ordnance transfer line of the deflagration type, and said output side being adapted for operative association with output ordnance means of the deflagration type, an illuminating charge means positioned in said cavity in operative relation with an input ordnance transfer line when such is connected to said input side of said initiator, a booster target charge means positioned in said cavity in operative relation with an output ordnance means when such is associated with said output side of said initiator, and radiation energy transmitting means positioned in sealing relation in said cavity intermediate said illuminating charge means and said booster target charge means, said illuminating charge means and said booster target means both being of the deflagrating type.

18. An optical through bulkhead initiator as defined by claim 17 wherein said illuminating charge means produces radiation in the infrared region of the electromagnetic spectrum and said radiation energy transmitting means comprises a window that is operative to transmit such radiation and to focus it on said booster target charge means.

19. An optical through bulkhead initiator as defined by claim 18 wherein said window comprises a lens made of material selected for efficient transmission of the radiation produced upon initiation of said illuminating charge means.

20. An optical through bulkhead initiator as defined by claim 18 further including a mechanical shutter means to provide a SAFE-ARM capability, said mechanical shutter means being opaque to the radiation produced by said illuminating charge means and manually movable from a "SAFE" position between said lens and said illuminating charge means in which the radiation produced by said illuminating charge means is blocked from reaching said lens to an "ARM" position in which such radiation is allowed to reach said lens.

* * * * *

UNITED STATES PATENT AND TRADEMARK OFFICE

CERTIFICATE OF CORRECTION

PATENT NO. : 4,660,472

DATED : April 28, 1987

INVENTOR(S) : George L. Stevens

It is certified that error appears in the above—identified patent and that said Letters Patent is hereby corrected as shown below:

In column 1, immediately after line 11, the following new paragraph should be inserted: --This invention was made with Government support under Contract N00030-84-C-0100 awarded by the Navy Department. The Government has certain rights in this invention.--

In the drawings, Fig. 1, the reference numeral 16 should be applied to the structure in which transfer lines 12 and 50 are inserted, and the reference numeral 20 should be applied to the cavity in body 18 which is provided with internal screw thread 22.

In the drawings, Fig. 3, the arrow for the "SAFF" position 70 should point downwardly, and the arrow for the "ARM" position 72 should point upwardly.

In column 3, line 27, "an" should read --a--.

In column 6, line 53, after "booster charge", the comma should be deleted and a period should be substituted therefor so that claim 11 ends with a period.

Signed and Sealed this

Nineteenth Day of January, 1988

*Attest:*

*Attesting Officer*

DONALD J. QUIGG

*Commissioner of Patents and Trademarks*